US006682390B2

(12) United States Patent
Saito

(10) Patent No.: US 6,682,390 B2
(45) Date of Patent: Jan. 27, 2004

(54) INTERACTIVE TOY, REACTION BEHAVIOR PATTERN GENERATING DEVICE, AND REACTION BEHAVIOR PATTERN GENERATING METHOD

(75) Inventor: Shinya Saito, Tokyo (JP)

(73) Assignee: Tomy Company, Ltd., Tokyo (JP)

( * ) Notice: Subject to any disclaimer, the term of this patent is extended or adjusted under 35 U.S.C. 154(b) by 39 days.

(21) Appl. No.: 09/885,922

(22) Filed: Jun. 22, 2001

(65) Prior Publication Data

US 2002/0016128 A1 Feb. 7, 2002

(30) Foreign Application Priority Data

Jul. 4, 2000 (JP) ..... 2000-201720

(51) Int. Cl.[7] ..... A63H 3/28
(52) U.S. Cl. ..... 446/268; 446/175; 446/297
(58) Field of Search ..... 446/175, 297, 446/298, 299, 300, 301, 302, 303, 397, 268

(56) References Cited

U.S. PATENT DOCUMENTS

| | | | | | |
|---|---|---|---|---|---|
| 4,245,430 | A | | 1/1981 | Hoyt | 46/266 |
| 4,451,911 | A | | 5/1984 | Klose et al. | 369/31 |
| 4,696,653 | A | * | 9/1987 | McKeefery | 446/175 |
| 4,840,602 | A | * | 6/1989 | Rose | 446/175 |
| 4,850,930 | A | | 7/1989 | Sato et al. | 446/175 |
| 4,857,030 | A | * | 8/1989 | Rose | 446/303 |
| 4,923,428 | A | | 5/1990 | Curran | 446/175 |
| 5,029,214 | A | * | 7/1991 | Hollander | 446/175 |
| 5,281,180 | A | * | 1/1994 | Lam et al. | 446/175 |
| 5,324,225 | A | | 6/1994 | Satoh et al. | 446/175 |
| 5,458,524 | A | * | 10/1995 | Lucas | 446/297 |
| 5,802,488 | A | * | 9/1998 | Edatsune | 704/231 |
| 6,089,942 | A | * | 7/2000 | Chan | 446/175 |
| 6,149,490 | A | | 11/2000 | Hampton et al. | 446/353 |
| 6,253,058 | B1 | | 6/2001 | Murasaki et al. | 434/308 |
| 6,445,978 | B1 | * | 9/2002 | Takamura et al. | 446/298 |
| 6,463,859 | B1 | * | 10/2002 | Ikezawa et al. | 463/53 |

FOREIGN PATENT DOCUMENTS

| | | | | | |
|---|---|---|---|---|---|
| CA | 2260160 | | | 5/1999 | |
| EP | 0745944 | A2 | | 12/1996 | |
| EP | 1074352 | A2 | * | 2/2001 | B25J/9/16 |
| EP | 1112822 | A1 | | 7/2001 | |
| EP | 1122038 | A1 | * | 8/2001 | B25J/13/00 |
| JP | 07160853 | A | * | 6/1995 | G06T/1/00 |
| JP | 8-202679 | | | 8/1996 | |
| JP | 10274921 | A | * | 10/1998 | G09B/9/00 |
| JP | 10333542 | A | * | 12/1998 | G09B/9/00 |
| JP | 2001105363 | A | * | 4/2001 | B25J/13/08 |
| WO | WO 97/14102 | | | 4/1997 | |
| WO | WO 99/32203 | | | 7/1999 | |
| WO | WO 00/67961 | | | 11/2000 | |

* cited by examiner

*Primary Examiner*—Derris H. Banks
*Assistant Examiner*—Urszula M Cegielnik
(74) *Attorney, Agent, or Firm*—Staas & Halsey LLP

(57) ABSTRACT

An interactive toy (1) comprises stimulus sensors (5) for detecting an inputted stimulus, actuators or the like (3, 4) for actuating the interactive toy (1), and a control unit (10) for controlling the actuators or the like (3, 4) so that the interactive toy (1) may take reaction behavior to the stimulus detected by the stimulus sensors (5). Here, the control unit (10) changes the reaction behavior of the interactive toy (1), according to a total value of generated action points caused by the reaction behavior of the interactive toy (1). Thus, the reaction behavior (output) of the interactive toy is made into points, and the reaction behavior of the interactive toy (1) is changed according to the total value of the points. Thereby, both enriching the variation related to the reaction behavior and prediction difficulty of the reaction behavior can be attempted.

11 Claims, 14 Drawing Sheets

FIG.5

| STAGE No. | CHARACTER PARAMETER | INPUT No. | OUTPUT No. | PROBABILITY (%) | VOICE No. | ACTION No. |
|---|---|---|---|---|---|---|
| S-1 | S1 | i-01 | o-S1000101 | 30 | vce(01) | act(01) |
| S-1 | S1 | i-01 | o-S1000102 | 50 | vce(02) | act(02) |
| S-1 | S1 | i-01 | o-S1000103 | 20 | vce(03) | act(03) |
| S-1 | S1 | i-02 | o-S1000201 | 50 | vce(04) | act(05) |
| Abbreviating the following | ... | ... | ... | ... | ... | ... |

31
32
33

FIG.6

| STAGE No. | CHARACTER PARAMETER | INPUT No. | OUTPUT No. | PROBABILITY (%) | VOICE No. | ACTION No. | |
|---|---|---|---|---|---|---|---|
| S-2 | S2 | i-01 | o-S2000101 | 10 | vce(01) | act(01) | 41 |
| S-2 | S2 | i-01 | o-S2000102 | 10 | vce(02) | act(02) | 42 |
| S-2 | S2 | i-01 | o-S2000103 | 10 | vce(22) | | 43 |
| S-2 | S2 | i-01 | o-S2000104 | 15 | vce(23) | | 44 |
| S-2 | S2 | i-01 | o-S2000105 | 20 | vce(24) | | 45 |
| S-2 | S2 | i-01 | o-S2000106 | 15 | vce(25) | | 46 |
| S-2 | S2 | i-01 | o-S2000107 | 20 | vce(26) | | 47 |
| S-2 | | i-02 | o-S2000201 | 10 | vce(04) | act(05) | |
| Abbreviating the following | ... | ... | ... | ... | ... | ... | |

*FIG. 7*

| STAGE No. | CHARACTER PARAMETER | INPUT No. | OUTPUT No. | PROBABILITY (%) | VOICE No. | ACTION No. |
|---|---|---|---|---|---|---|
| S-3 | A1 | i-01 | o-S3A10101 | 20 | pos(3000) | |
| S-3 | A1 | i-01 | o-S3A10102 | 20 | pos(5000)+vce(56) | |
| S-3 | A1 | i-01 | o-S3A10103 | 10 | pos(2000)+vce(60) | |
| S-3 | A1 | i-01 | o-S3A10104 | 10 | vce(100) | |
| S-3 | A1 | i-01 | o-S3A10105 | 10 | pos(2000)+vce(82) | |
| S-3 | A1 | i-01 | o-S3A10106 | 10 | pos(2000)+vce(77) | |
| S-3 | A1 | i-01 | o-S3A10107 | 10 | vce(99) | act(01) |
| S-3 | A1 | i-01 | o-S3A10108 | 5 | pos(2000)+vce(88) | |
| S-3 | A1 | i-01 | o-S3A10109 | 5 | pos(2000)+vce(88) | act(10) |
| S-3 | A1 | i-02 | o-S3A10201 | 10 | vce(04) | act(05) |
| Abbreviating the middle | ... | ... | ... | ... | ... | ... |
| S-3 | A2 | i-01 | o-S3A20101 | 20 | vce(145) | |
| S-3 | A2 | i-01 | o-S3A20102 | 20 | vce(155) | |
| S-3 | A2 | i-01 | o-S3A20103 | 10 | vce(107) | |
| Abbreviating the following | ... | ... | ... | ... | ... | ... |

FIG.8

| STIMULUS No. | STIMULUS PART (CONTENT) |
|---|---|
| i-01 | hit head |
| i-02 | punch head |
| i-03 | throat |
| i-04 | back |
| i-05 | sound(right) |
| i-06 | sound(left) |
| i-07 | sound(others) |
| i-08 | light(bright) |
| i-09 | light(bright,flicker) |
| i-10 | light(dark) |
| i-11 | angle(normal) |
| i-12 | angle(right) |
| i-13 | angle(left) |
| i-14 | angle(front) |
| i-15 | angle(back) |
| i-16 | no input |
| i-17 | nose |
| Abbreviating the following | ... |

FIG.9

| VOICE No. | VOICE CONTENT |
|---|---|
| vce(01) | yap! |
| vce(02) | arf! |
| vce(22) | ouch! |
| vce(23) | Arf surprised ! |
| vce(56) | what ? |
| vce(60) | You hurt me ! |
| pos (X) | non-voice time |
| Abbreviating the following | ... |

| ACTION No. | ACTION CONTENT |
|---|---|
| act (01) | draw back |
| act (02) | stand up |
| act (03) | riot |
| act (04) | stop |
| act (05) | wag tail |
| act (06) | wag tail (intensely) |
| act (07) | shake head at right and left |
| act (08) | shake whole body at right and left |
| act (09) | turn body to right |
| act (10) | turn body to left |
| act (11) | raise head |
| act (12) | walk (3 steps) |
| Abbreviating the following | ... |

INTERACTIVE TOY, REACTION BEHAVIOR PATTERN GENERATING DEVICE, AND REACTION BEHAVIOR PATTERN GENERATING METHOD

BACKGROUND OF THE INVENTION

1. Field of the Invention

The present invention relates to an interactive toy such as a dog type robot or the like, a reaction behavior pattern generating device and a reaction behavior pattern generating method of an imitated life object to a stimulus.

2. Description of Related Art

In earlier technology, an interactive toy which acts as if it were communicating with a user, has been known. As a typical example of this kind of interactive toy, a robot having a form of a dog or a cat or the like is mentioned. Besides, a virtual pet, which is incarnated by displaying on a display or the like, or the like, corresponds to this kind of interactive toy. In the specification, the interactive toy incarnated as hardware, or the virtual pet incarnated as software, is named generically and suitably called an "imitated life object". A user can enjoy by observing the imitated life object, which acts in response to the stimulus given from the outside, and comes to be able to carry out empathy.

For example, in the Japanese Patent Publication No. Hei 7-83794, a technology of generating reaction behavior of an interactive toy is disclosed. Concretely, a specific stimulus (e.g. a sound) given artificially is detected, and the number of times (the number of input times of the stimulus) is counted. Then, the contents of reaction of the interactive toy are changed by the counted number. Therefore, it is possible to give the user such feeling as the interactive toy is growing up.

SUMMARY OF THE INVENTION

An object of the present invention is to provide a novel reaction behavior generating technique, which makes an interactive toy take reaction behavior.

Further, another object of the present invention is to enable to set reaction behavior of an interactive toy rich in variation, and to make the toy take reaction behavior of rich individuality.

In order to solve the above-described problems, according to a first aspect of the present invention, an interactive toy comprising a stimulus detecting member for detecting an inputted stimulus, an actuating member for actuating the interactive toy, and a control member for controlling the action member to make the interactive toy take reaction behavior to the stimulus detected from the stimulus detecting member, is provided. Here, the above-described control member changes the reaction behavior of the interactive toy according to the total value of generated action points caused by the reaction behavior of the interactive toy. Thus, the reaction behavior (output) of the interactive toy is made into points, and the reaction behavior of the interactive toy is changed according to the total value of the points. Thereby, both enriching the variation over the reaction behavior and prediction difficulty of the reaction behavior can be attempted.

Here, in the interactive toy of the present invention, the generated action point caused by the reaction behavior of the interactive toy, is preferable to be the number of points according to the contents of the reaction behavior. For example, it can be the number of points corresponding to the time of reaction behavior.

Further, in the interactive toy of the present invention, after distributing an action point at least to a first total value or a second total value, according to a predetermined rule, it is preferable to count the first total value and the second total value. It is also desirable to distribute the action point by the contents of the inputted stimulus. For example, the generated action point caused by the reaction behavior corresponding to a contact stimulus, may be distributed to the first total value, and the generated action point caused by the reaction behavior corresponding to a non-contact stimulus, may be distributed to the second total value. Thus, when distributing the action point, the control member may count separately the first total value and the second total value. Then, the control member may determine the reaction behavior of the interactive toy based on the first total value and the second total value.

Moreover, in the interactive toy of the present invention, it is preferable to further provide a character state map, in which a plurality of character parameters that affect the reaction behavior of the interactive toy is set. Further, the character parameters are written in the character state map by matching with the first total value and the second total value. In this case, the control member may select a character parameter based on the first total value and the second total value, with reference to the character state map. Besides, the control member may determine the reaction behavior of the interactive toy based on the selected character parameter.

Furthermore, in the interactive toy of the present invention, the control member may count the first total value and the second total value within the time limit set at random. Thereby, prediction of the reaction behavior can be made much more difficult.

According to a second aspect of the present invention, a reaction behavior pattern generating device for generating a reaction behavior pattern of an imitated life object to an inputted stimulus, comprises a reaction behavior pattern table, a selection member, a counting member, and an update member. In the reaction behavior pattern table, the reaction behavior pattern of the imitated life object to a stimulus is written by relating with a character parameter, which affects the reaction behavior of the imitated life object. The selection member selects the reaction behavior pattern to the inputted stimulus based on the set value of the character parameter, with reference to the reaction behavior pattern table. Then, the counting member counts the total value of generated action points caused by the reaction behavior of the imitated life object according to the reaction behavior pattern selected by the selection member. Moreover, the update member updates the set value of the character parameter, according to the total value of the action points.

According to a third aspect of the present invention, a reaction behavior pattern generating device for generating a reaction behavior pattern of an imitated life object to an inputted stimulus, comprises a character state map, a counting member, and an update member. In the character state map, a plurality of character parameters, which affect reaction behavior of the imitated life object, are set. The character parameters are also written in the character state map by matching with a first total value and a second total value related to an action point. The counting member counts the first total value and the second total value after distributing the generated action point caused by the reaction behavior of the imitated life object at least to the first total value or the second total value, according to a predetermined rule. The update member updates the set value of a character parameter by selecting the character parameter based on the first total value and the second total value, with reference to the above-described character state map. In such a structure, the reaction behavior of the imitated life object to the inputted stimulus is determined based on the set value of the character parameter. Thus, since the reaction behavior of the imitated life object is set based on a plurality of character parameters, it is difficult for a user to predict the reaction behavior of the imitated life object.

Here, in the second or third aspect of the present invention, the counting member is preferable to count the total value within the time limit set at random. Thereby, prediction of the reaction behavior can be made much more difficult.

According to a fourth aspect of the present invention, it relates to a reaction behavior pattern generating method for generating a reaction behavior pattern of an imitated life object to an inputted stimulus. The generating method comprises the following steps. At first, in a selecting step, the reaction behavior pattern of the imitated life object to an inputted stimulus is selected based on the present set value of a character parameter, with reference to a reaction behavior pattern table, in which the reaction behavior pattern of the imitated life object to a stimulus is written by relating with the character parameter that affects the reaction behavior of the imitated life object. Next, in a counting step, the total value of generated action points caused by the reaction behavior of the imitated life object according to the selected reaction behavior pattern, is counted. Then, in an updating step, the set value of the character parameter is updated according to the total value of the action points.

According to a fifth aspect of the present invention, it relates to a reaction behavior pattern generating method for generating a reaction behavior pattern of an imitated life object to an inputted stimulus. The generating method comprises the following steps. At first, in a counting step, after distributing a generated action point caused by the reaction behavior of the imitated life object at least to a first total value or a second total value, according to a predetermined rule, the first total value and the second total value are counted. Next, in an updating step, a set value of a character parameter is updated by selecting the character parameter based on the first total value and the second total value, with reference to a character state map, in which a plurality of character parameters that affect the reaction behavior of the imitated life object are set. The character parameters are written in the character state map by matching with the first total value and the second total value related to an action point. Then, in a determining step, the reaction behavior of the imitated life object to the inputted stimulus is determined based on the set value of the character parameter.

Here, in any one of the second to the fifth aspects of the present invention, the generated action point caused by the reaction behavior of the imitated life object, is preferable to be the number of points according to the contents of the reaction behavior. For example, it can be the number of points corresponding to the reaction behavior time of the imitated life object.

Further, in the third or the fifth aspect of the present invention, the generated action point caused by the reaction behavior of the imitated life object, is preferable to be distributed to the first total value or the second total value, according to the contents of the inputted stimulus. For example, the generated action point caused by the reaction behavior corresponding to a contact stimulus may be distributed to the first total value, and the generated action point caused by the reaction behavior corresponding to a non-contact stimulus, may be distributed to the second total value.

Moreover, in the fourth or the fifth aspect of the present invention, the above-described counting step is preferable to count the total value within the time limit set at random. Thereby, prediction of the reaction behavior can be made much more difficult.

BRIEF DESCRIPTION OF THE DRAWINGS

The present Invention will become more fully understood from the detailed description given hereinbelow and the appended drawings which given by way of illustration only, and thus are not intended as a definition of the limits of the present invention, and wherein;

FIG. 5 is an explanatory diagram showing a reaction behavior pattern table of a first stage according to the embodiment of the present invention;

FIG. 6 is an explanatory diagram showing a reaction behavior pattern table of a second stage according to the embodiment of the present invention;

FIG. 7 is an explanatory diagram showing a reaction behavior pattern table of a third stage according to the embodiment of the present invention;

FIG. 8 is an explanatory diagram showing stimulus data according to the embodiment of the present invention;

FIG. 9 is an explanatory diagram showing voice data according to the embodiment of the present invention;

PREFERRED EMBODIMENT OF THE INVENTION

Referring to the appended drawings, the embodiment of the interactive toy according to the present invention will be explained as the following.

Figure 1:
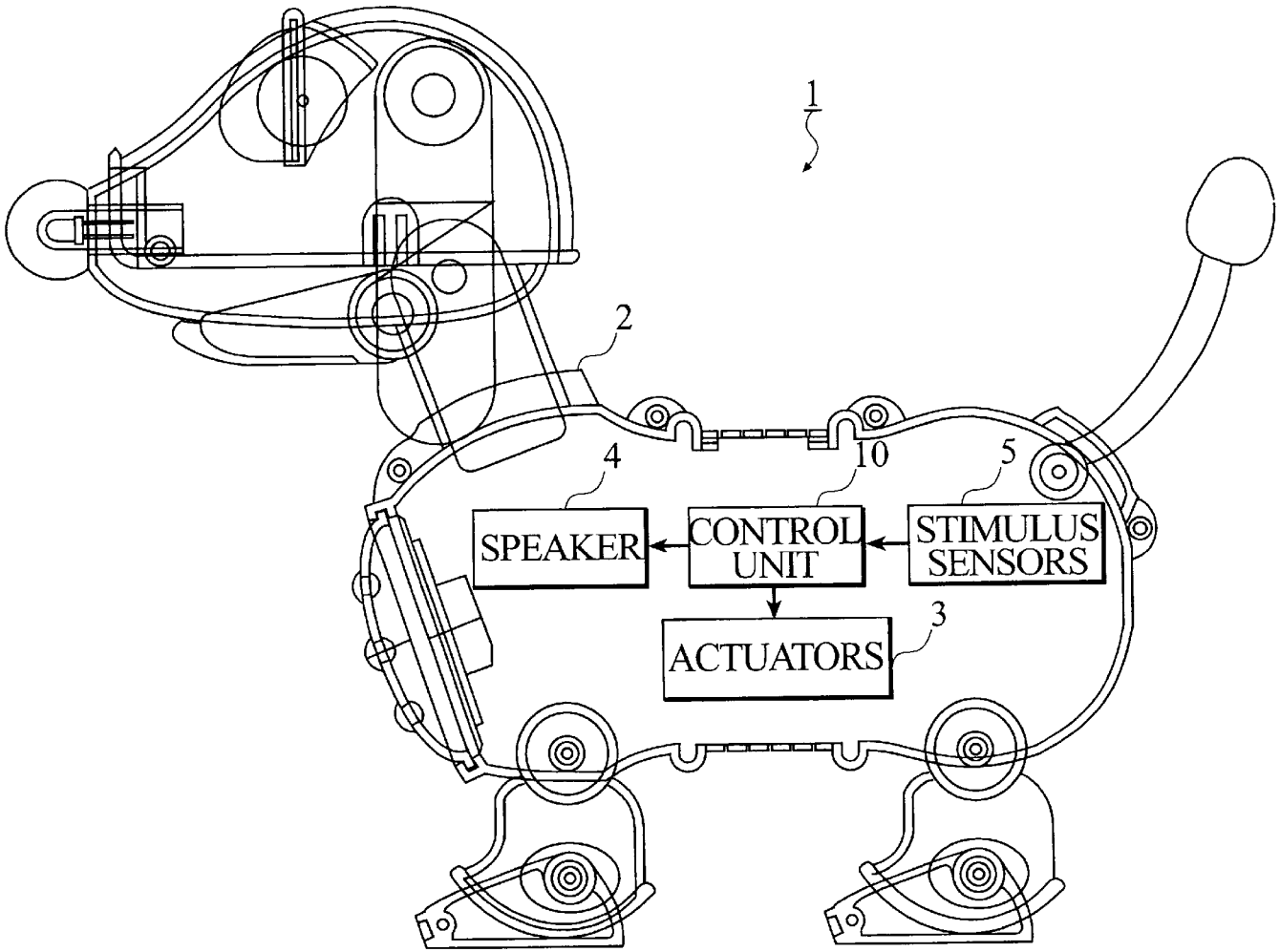
FIG. 1 is a schematic block diagram showing an interactive toy according to an embodiment of the present invention.

FIG. 1 is a schematic diagram showing a structure of an interactive toy (a dog type robot) according to an embodiment of the present invention. The dog type robot 1 has an appearance form which imitated a dog, the most popular animal as a pet. In the inside of its body portion 2, various kinds of actuators 3 as actuating members to actuate a leg, a neck and a tail or the like, a speaker 4 to utter a voice, various kinds of stimulus sensors 5 as stimulus detecting members installed in predetermined parts such as a nose, or a head portion or the like, and a control unit 10 as a control member, are provided. Here, the stimulus sensors 5 are sensors that detect the stimulus received from the outside. A touch sensor, an optical sensor, and a microphone or the like are used therein. The touch sensor is a sensor that detects whether a user touched a predetermined portion of the dog type robot 1 or not, that is, a sensor for detecting a touch stimulus. The optical sensor is a sensor that detects the change of the external brightness, that is, a sensor for detecting a light stimulus. The microphone is a sensor that detects addressing form a user, that is, a sensor for detecting a sound stimulus.

The control unit 10 mainly comprises a microcomputer, RAM, and ROM or the like. A reaction behavior pattern of the dog type robot 1 is determined based on a stimulus signal from the stimulus sensors 5. Then, the control unit controls the actuators 3 or the speaker 4 so that the dog type robot 1 will act according to the determined reaction behavior pattern. The character state of the dog type robot 1 (the character determined by later-described character parameter XY), which specifies the character or the degree of growth of the dog type robot 1, changes by what reaction behavior the dog type robot 1 takes to the received stimulus. The reaction behavior of the dog type robot 1 changes according to the character state. Since the correspondence is rich in variation, a user receives an impression as if the user were communicating with the dog type robot 1.

Figure 2:
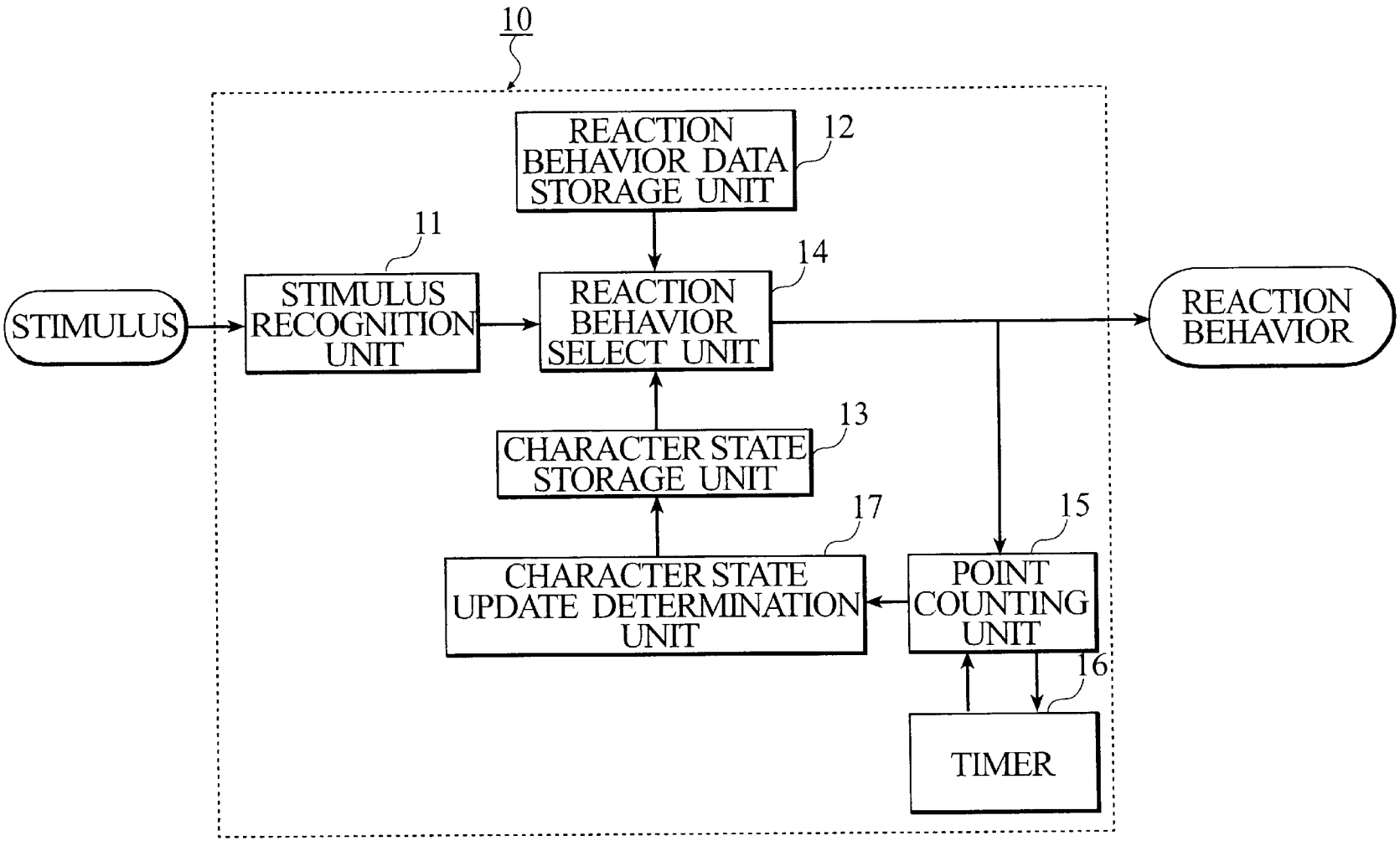
FIG. 2 is a functional block diagram showing a control unit according to the embodiment of the present invention.

FIG. 2 is a view showing a functional block structure of the control unit 10, which generates a reaction behavior pattern. The control unit 10 comprises a stimulus recognition unit 11, a reaction behavior data storage unit 12 (ROM), a character state storage unit 13 (RAM), a reaction behavior select unit 14 as a selection member, a point counting unit 15 as a counting member, timer 16, and a character state update determination unit 17 as an update member.

The stimulus recognition unit 11 detects the existence of a stimulus from the outside based on the stimulus signal from the stimulus sensors 5, and distinguishes the contents of the stimulus (kinds or stimulus places). In the embodiment of the present invention, as described later, the reaction behavior (output) of the dog type robot 1 changes with contents of a stimulus. There are the followings as the stimulus recognized in the embodiment of the present invention.

[Recognized Stimulus]

Figure 3:
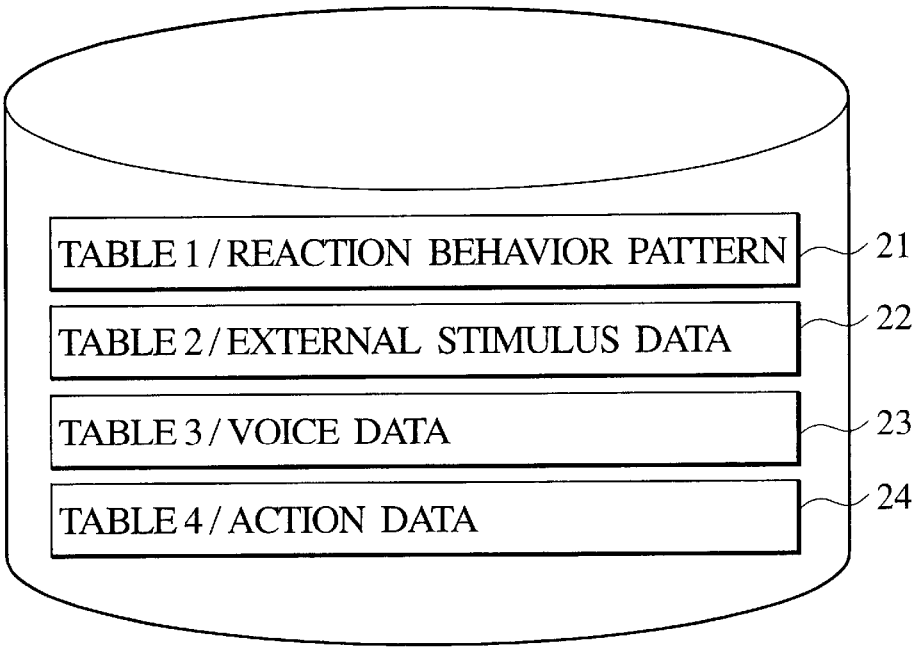
FIG. 3 is a view showing a structure of a reaction behavior data storage unit of the control unit according to the embodiment of the present invention.
Figures 10, 11:
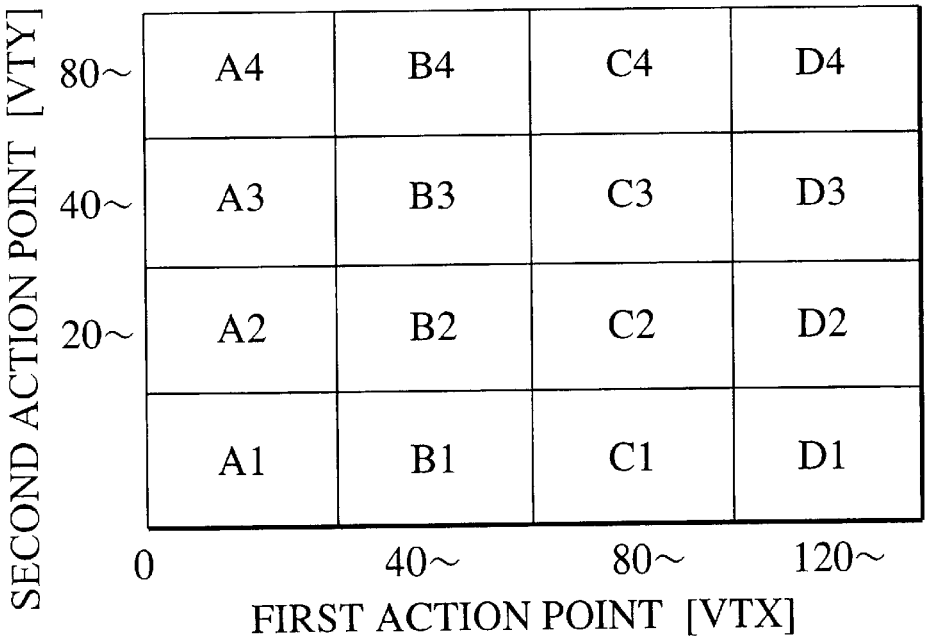
FIG. 10 is an explanatory diagram showing action data according to the embodiment of the present invention.
FIG. 11 is an explanatory diagram showing a character state map according to the embodiment of the present invention.

1. Contact Stimulus touch stimulus: stimulus part (head, throat, nose, or back), or stimulus method (stroking, hitting) or the like 2. Non-contact Stimulus sound stimulus: addressing of a user, or an input direction (right or left) or the like light stimulus: light and shade of the outside, or flicker or the like In the reaction behavior data storage unit 12, various kinds of data related to the reaction behavior that the dog type robot 1 takes, are stored. Concretely, as shown in FIG. 3, a reaction behavior pattern table 21, an external stimulus data table 22, a voice data table 23, and an action data table 24 or the like, are housed therein. In addition, since the growth stages of the dog type robot 1 are set in three stages, three kinds of reaction behavior pattern tables 21 are prepared according to the stages (FIGS. 5 to 7). Further, a character state map shown in FIG. 11 is also housed therein.

In the character state storage unit 13, a character parameter XY (the present set value) for specifying the character of the dog type robot 1, is housed. The character of the dog type robot 1 is determined by the character parameter XY set at present. A fundamental behavior tendency, the reaction behavior to stimulus, and degree of the growth, or the like, depend on the character parameter XY. In other words, changes in the reaction behavior of the dog type robot 1 occurs by changes of the value of the character parameter XY housed in the character state storage unit 13.

The reaction behavior select unit 14 determines the reaction behavior pattern to the inputted stimulus by considering the character parameter XY stored in the character state storage unit 13. Concretely, with reference to the reaction behavior pattern tables for every growth stage shown in FIGS. 5 to 7, one of the reaction behavior patterns to a certain stimulus is selected according to the appearance probability to which is prescribed beforehand. Then, the reaction behavior select unit 14 controls the actuators 3 or the speaker 4, and makes the dog type robot 1 behave as if it were taking reaction behavior to the stimulus.

The point counting unit 15 counts a generated action point caused by the reaction behavior of the dog type robot 1. The action point is counted (added/subtracted) to the total value of the action points, and the latest total value is stored in the RAM. Here, an "action point" means a generated score caused by the reaction behavior (output) of the dog type robot 1. The total value of the action points corresponds to the level of communication between the dog type robot 1 and a user. It also becomes a base parameter related to the update of the character parameter XY, which determines the character state of the dog type robot 1.

In the embodiment of the present invention, the output time of the control signal to the speaker 4 (in other words, the voice output time of the speaker 4), or the output time of the control signal to the actuators 3 (in other words, the actuate time of the actuators 3) is counted by the timer 16. Then, a point correlated with the counted output time, is made to be an action point. For example, when the voice output time of the speaker 4 is 1.0 second, the action point caused by this, is 1.0 point. Therefore, when reaction behavior is carried out, the longer the output time of the control signal to the actuators 3 or the speaker 4, the larger the number of points of the generated action point caused by the output time becomes.

Here, when a stimulus thought that unpleasant for the dog type robot 1, is inputted (for example, hitting the head portion of the dog type robot 1, or the like), the point counting unit 15 carries out a subtraction process of the action point (minus counting). The minus counting of the action point means growth obstruction (or aggravation of communication) of the dog type robot 1.

The main feature of the present invention is the point that the degree of growth or the character of the dog type robot 1 is determined according to the contents of the reaction behavior (output)of the dog type robot 1. This point is greatly different from the earlier technology that counts the number of times of the given stimulus (input). Therefore, proper techniques other than the above-described calculation technique of the action point may be used within a range of such an object. For example, a microphone or the like may be provided separately in the inside of the body portion 2, and the output time of the actually uttered voice may be counted. Then, an action point may be generated by making the counted time (the reaction behavior time) into points. Further, an action behavior point may be set beforehand for every action pattern, which constitutes the action pattern table. Then, the action point corresponding to the actually performed reaction behavior (output) may be made a counting object.

The character state update determination unit 17 suitably updates the value of the character parameter XY based on the total value of the action points. The updated character parameter XY (the present value) is housed in the character state storage unit 13, and the degree of growth, the character, the basic posture, and the reaction behavior to a stimulus or the like of the dog type robot 1, are determined according to the character parameter XY.

The stimulus that the dog type robot 1 received, is classified into categories, concretely, in a contact stimulus (the touch stimulus) and a non-contact stimulus (the light stimulus or the sound stimulus) corresponding to the contents of the stimulus. Basically, with the reaction behavior to the contact stimulus and the reaction behavior to the non-contact stimulus, the action points for each stimulus are counted separately. Here, the total value of the action points based on the reaction behavior to the contact stimulus is made to be a first total value VTX. Further, the total value of the action points based on the reaction behavior to the non-contact stimulus is made to be a second total value VTY.

Figure 4:
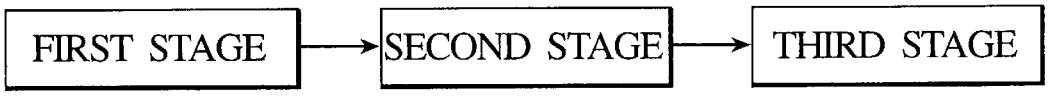
FIG. 4 is an explanatory diagram showing transition of growth stages according to the embodiment of the present invention.

In the embodiment of the present invention, as shown in FIG. 4, three stages are set for growth stages. The behavior of the dog type robot 1 develops (grows) with shift of the growth stage. That is, the dog type robot 1 behaves as the same level as a dog in the first stage, which is an initial stage. In the second stage, behavior of the in-between level of a dog and human is taken. Then, it behaves as the same level as a human in the third stage, which is a final stage. Thus, three reaction behavior pattern tables are prepared (FIGS. 5 to 7) so that the dog type robot 1 may take the reaction behavior corresponding to the growth stages.

FIGS. 5 to 7 are explanatory diagrams showing the reaction behavior pattern tables from the first to the third growth stages. With the reaction behavior patterns written in the tables, the information written in the following seven fields, are related. At first, in the field "STAGE No.", a number (S1 to S3) that specifies one of the growth stages, is written. In the field "CHARACTER PARAMETER", the character parameter XY that determines a fundamental character of the dog type robot 1, is written. As for an X value of the character parameter XY, one of the "S", and "A" to "D" is set, and as for a Y value thereof, one of the "1" to "4" is set. Since the character parameters XY in FIG. 5 are uniformly set to "S1", the character of the dog type robot 1 in the first stage (a dog level) does not change. Similarly, since the character parameters XY in FIG. 6 are uniformly set to "S2", the character of the dog type robot 1 in the second stage (a dog+human level) does not change. On the other hand, in the third stage (a human level), since the character parameters XY are classified into sixteen kinds from "A1" to "D4", by the update of the character parameter XY, the character of the dog type robot 1 changes to sixteen kinds (cf. FIGS. 7 and 11).

Further, in the field "INPUT No." as shown in FIGS. 5 to 7, stimulus numbers (i-01 to i-07 . . . ), which show the classifications (the stimulus given parts or contents) of the stimulus (input) from the outside, are written. The correspondence relation between the stimulus numbers and their meanings are referred to FIG. 8. Further, in the field "OUTPUT No.", an output ID, which shows the contents of the reaction behavior (output) of the dog type robot 1, is written. A voice number and an action number corresponding to the output ID are written in each of the field "VOICE No." and the field "ACTION No.". The correspondence relation between voice number and voice contents is referred to FIG. 9. The correspondence relation between action numbers and action contents is referred to FIG. 10. In addition, pos() written in the field "VOICE No." in FIG. 7, shows that the pause time is "" seconds. Moreover, in the field "PROBABILITY", an appearance probability of the reaction behavior pattern to a certain stimulus is selection member.

(First Stage)

The reaction behavior of the dog type robot 1 in the first stage (the dog level) will be explained. Referring to FIG. 5, for example, when a user hits the dog type robot 1 on the head (a stimulus No.="i-01"), three reaction behavior patterns 31 to 33 are prepared as reactions to the stimulus. Each of the behavior patterns 31 to 33 appears in 30%, 50%, and 20% of probability, respectively. After taking this appearance probability into consideration, supposing the reaction behavior pattern 31 is selected based on a random number, the voice "vce(01)" and the action "act(01)" will be selected. As a result, according to FIGS. 9 and 10, the dog type robot 1 "draws back" yelping "yap!", that is, the dog type robot 1 takes the same action as an actual dog.

Next, the reaction behavior of the dog type robot 1 in case that it has grown and shifted to the second stage (the dog+human level), will be explained. Referring to FIG. 6, for example, when a user hits the dog type robot 1 on the head (a stimulus No.="i-01"), seven behavior patterns 41 to 47 are prepared as reactions to the stimulus. Predetermined appearance probability is prescribed to every behavior pattern 41 to 47. Here, supposing the reaction behavior 44 is selected, the voice "vce(23)" will be selected. As a result, according to FIG. 9, the dog type robot 1 utters as "Arf surprised!", and takes an action close to a human.

When the dog type robot 1 further grows, and becomes to the third stage (the human level), for example, it takes the same action as a human such as saying "what?", or "you hurt me!" or the like. Further, in order to express an attitude that the dog type robot 1 is lost in thought, a pause time is suitably set, and then a voice is uttered. In the third stage, the character parameters A1 to D4 are assigned to each cell of 4×4 matrix shown in FIG. 11. Therefore, the dog type robot 1 that is grown up to this level is capable of taking sixteen kinds of basic characters. The relation between a character parameter XY and a character is shown below.

[Character parameter XY and character]

| | |
|---|---|
| A1: apathy | B1: electrical |
| A2: retired | B2: cool |
| A3: liar | B3: lowbrow |
| A4: bad child | B4: anti-social |
| C1: timid | D1: spoiled child |
| C2: high-handed | D2: crybaby |
| C3: Mr. Standby | D3: meddlesome |
| C4: fake honor student | D4: good child |

For example, when the character parameter XY is "A1", the character of the dog type robot 1 is an "apathy type". In this case, the dog type robot 1 often takes a posture of lying down and facing its head down, and hardly talks. Further, when the character parameter XY is "D1", the dog type robot 1 is a "spoiled child". It often takes a posture of sitting down and facing its head up a little, and talks well. Thus, the basic posture or the character and behavior tendency, or the like, is set to each character parameter XY. In addition, as described later, the character parameter XY in the third stage is updated suitably by the total value of the action points generated according to the reaction behavior (output) performed by the dog type robot 1.

Figure 12:
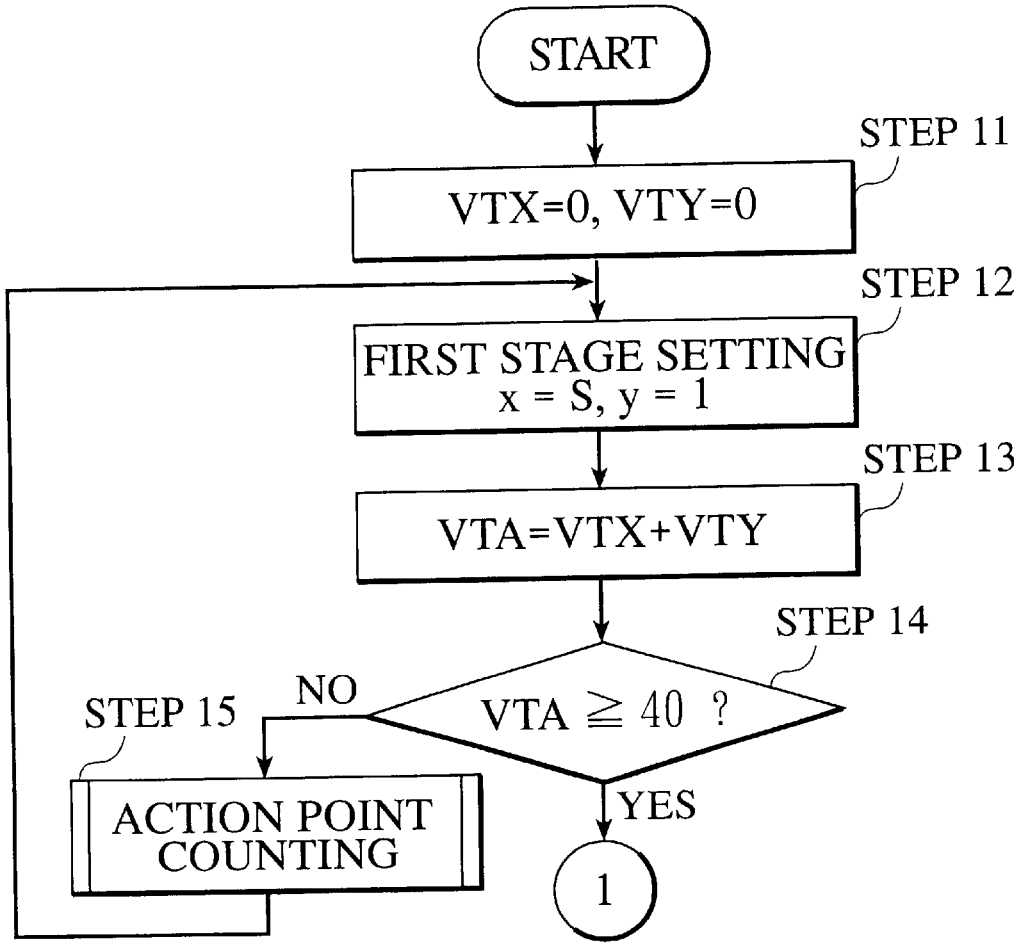
FIG. 12 is a flowchart showing a process procedure in the first stage according to the embodiment of the present invention.

Next, a process procedure of the control unit 10 in each growth stage, will be explained. FIG. 12 is a flowchart showing the process procedure of the first stage (the dog level). At first, in Step 11, the total values VTX and VTY of the action points are reset (VTX=0 and VTY=0). Next, in Step 12, the X value of the character parameter XY (the present set value), which is housed in the character state storage unit 14, is set to "S", and the Y value thereof is set to "1" (the character parameter S1 means the first stage). Then, in Step 13, the sum of the first total value VTX and the second total value VTY, that is, an aggregate total value VTA of the action points, is calculated. The aggregate total value VTA corresponds to the amount of communication between a user and the dog type robot 1, and becomes a value for a determination when shifting from the first stage to the second stage.

In Step 14 following Step 13, the aggregate total value VTA of the action points is judged whether it has reached a determination threshold value (40 points as an example), which is required for shifting to the second stage. When it has reached the determination threshold value, it is judged that sufficient amount of communications to shift to the next growth stage is secured. Therefore, it progresses to Step 21 in FIG. 13, and the second stage is started. On the other hand, when the aggregate total value VTA has not reached the determination threshold value, it progresses to an "action point counting process of Step 15.

Figure 16:
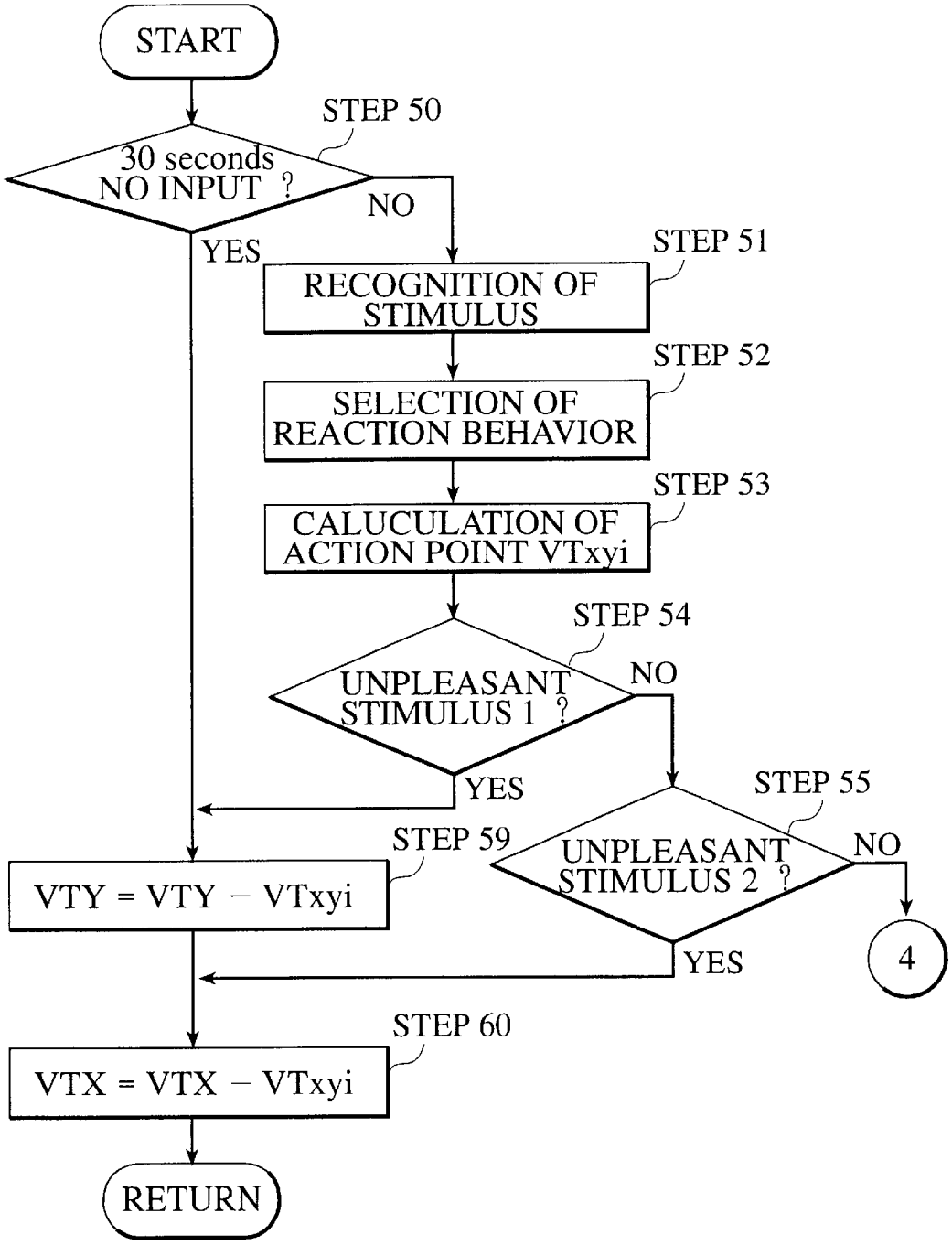
FIG. 16 is a flowchart showing an action counting process procedure according to the embodiment of the present invention.
Figure 17:
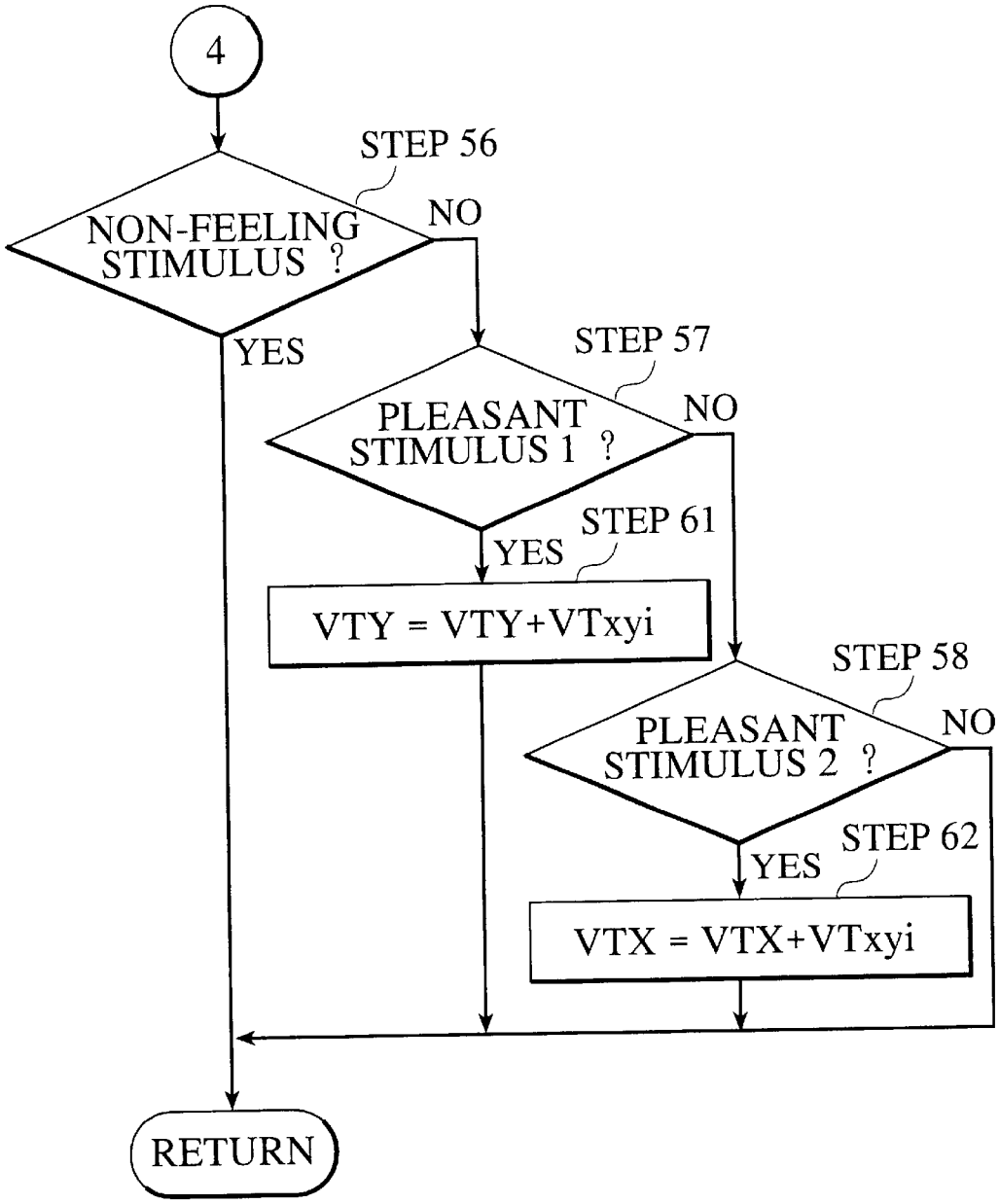
FIG. 17 is a flowchart showing an action counting process procedure according to the embodiment of the present invention.

FIGS. 16 and 17 are flowcharts showing a detailed procedure of the "action point counting process" in Step 15. In addition, the same process as Step 15 is also carried out over Steps 25 and 45 that will be described later.

At first, by the serial judgment of Steps 50, and 54 to 58, a classification group of the input stimulus is determined. The dog type robot 1 takes the reaction behavior to the inputted stimulus according to the reaction behavior pattern table shown in FIG. 5. Then, the total values VTX and VTY of the action points are updated suitably according to the action point VTxyi corresponding to the time (the output time) when the dog type robot 1 has taken the reaction behavior. The generated action point caused by the contact stimulus follows Steps 54 to 58 (a distribution rule) in FIGS. 16 and 17. Then, after the action point is suitably distributed to the first total value VTX or the second total value VTY, the total values VTX and VTY are counted.

[Classification Groups of Input Stimulus]

1. Unpleasant stimulus 1: stimulus with high degree of displeasure, such as touching a nose, or the like
2. Unpleasant stimulus 2: contact stimulus with low degree of displeasure, such as hitting a head, or the like
3. Non-feeling stimulus
4. Pleasant stimulus 1: non-contact stimulus, such as addressing, or the like
5. Pleasant stimulus 2: contact stimulus, such as stroking a head, nose, and back, or the like
6. Others (when negative determination is carried out in Steps 54 to 58)

At first, when affirmative determination is carried out in Step 50, that is, when there is no input of a stimulus within a predetermined period (for example, 30 seconds), it progresses to the procedure after Step 59, and is made to act toward obstructing the growth of the dog type robot 1. That is, the action point VTxyi is subtracted from the first total value VTX (Step 59). The action point VTxyi is also subtracted from the second total value VTX (Step 60). When the state that no stimulus is inputted, is continued, the dog type robot 1 also takes a predetermined behavior (output), so that the action point VTxyi caused by the behavior, is generated.

On the other hand, when negative determination is carried out in Step 50, that is, when there is an input of a stimulus within a predetermined period, it progresses to Step 51, and the inputted stimulus is recognized. Then, a reaction behavior pattern corresponding to the recognized inputted stimulus is selected (Step 51), the output of the actuators 3 and the speaker 4 are controlled according to the selected reaction behavior pattern (Step 52). Then, the action point VTxyi corresponding to the output control period is calculated (Step 53).

In Steps 54 to 58 following Step 53, the classification group of the inputted stimulus is determined. When the inputted stimulus corresponds to the above-described classification group 1, it progresses to Step 59 by passing through the affirmative determination of Step 54. In this case, as same as when the stimulus is un-inputted, the action point VTxyi is distributed to the first and the second total values VTX and VTY. Then, the action point VTxyi is subtracted from each total value VTX and VTY (Steps 59 and 60). Thereby, it acts toward obstructing the growth of the dog type robot 1.

When the inputted stimulus corresponds to the classification group 2, it progresses to Step 60 by passing through the affirmative determination of Step 54. In this case, the action point VTxyi is distributed to the first total value VTX, and the action point VTxyi is subtracted from the first total value VTX (Step 60). However, in this case, since the degree of displeasure, which the dog type robot 1 feels, is not so high, the aggregate total value VTA does not decrease like the case of classification group 1.

On the other hand, when the inputted stimulus corresponds to the classification group 3 or 6, the process is finished without changing the total values VTX and VTY by the affirmative determination of Step 56 or the negative determination of Step 58.

Further, when the inputted stimulus corresponds to the classification group 4 or 5, that is, when a pleasant stimulus for the dog type robot 1 is given, it acts toward promoting the growth of the dog type robot 1. Concretely, when the affirmative determination is carried out in Step 57, the action point VTxyi corresponding to the reaction behavior time is distributed to the second total value VTY, so that the second total value VTY is added (Step 61). On the other hand, when the affirmative determination is carried out in Step 58, the action point VTxyi is distributed to the first total value VTX, so that the first total value VTX is added (Step 62).

Thus, the total values VTX and VTY of the action points are set so as to decrease when reaction behavior (output) corresponding to an unpleasant stimulus (input) is taken, and to increase when reaction behavior corresponding to a pleasant stimulus is taken. In other words, when there is a happy thing for the dog type robot 1, it is contributed to the growth of the dog type robot 1. On the contrary, when the dog type robot 1 receives an unpleasant stimulus or when it is let alone, the growth of the dog type robot 1 is obstructed.

When the "action point counting process" in Step 15 in FIG. 12 is finished, it returns to Step 12. Then, the first stage continues until the aggregate total value VTA reaches 60. In this stage, the dog type robot 1 behaves the same as a dog, and utters a voice such as "arf!" or "yap!", according to a situation. Then, whenever the dog type robot 1 takes reaction behavior, an action point VTxyi is suitably added/subtracted to the total values VTX and VTY.

(Second Stage)

When the aggregate total value VTA has reached 40, the first stage shifts to the second stage (the dog+human level). In the second stage, the dog type robot 1 takes the in-between behavior of a dog and a human. As an uttered voice, there is an in-between vocabulary of a dog and a human, such as, "ouch!" or "Arf surprised!", except "arf!" or "yap!", is uttered. The second stage is the middle stage that the dog type robot 1 has not turned completely into human yet although it grew up and the vocabulary also approached human.

Figure 13:
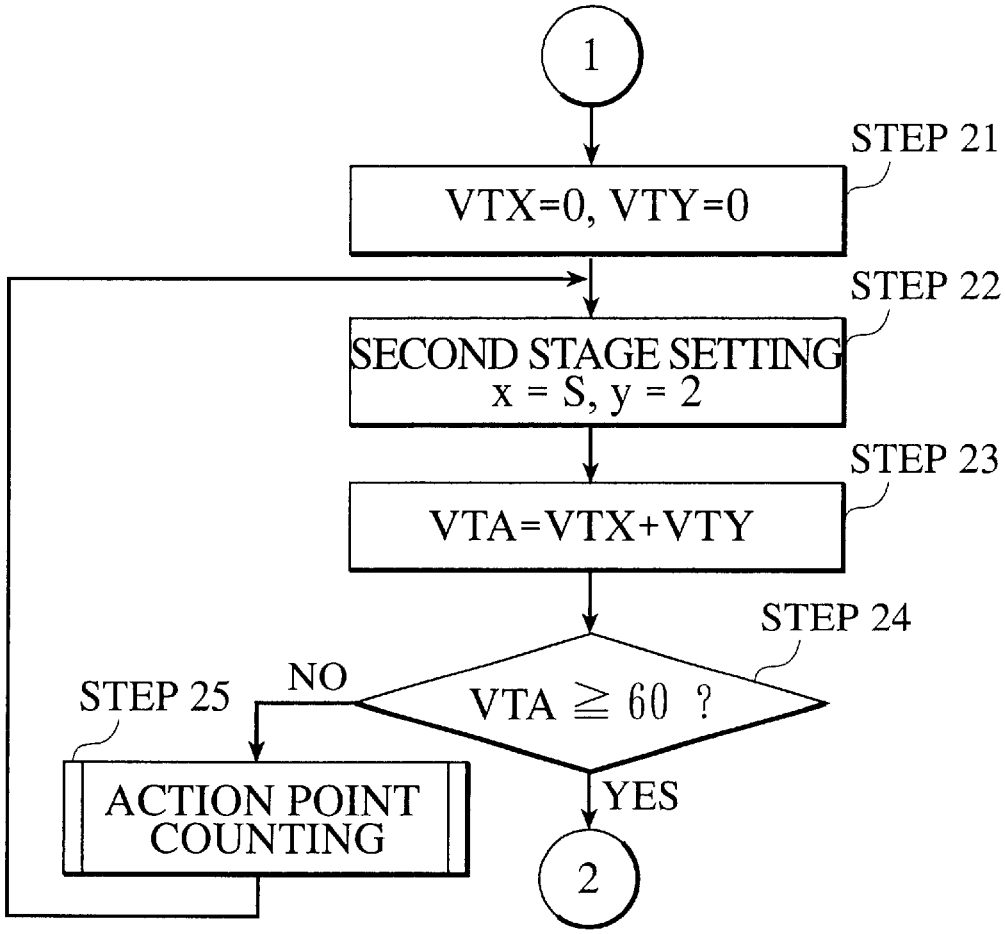
FIG. 13 is a flowchart showing a process procedure in the second stage according to the embodiment of the present invention.

FIG. 13 is a flowchart showing a process procedure in the second stage. At first, in Step 21, the total values VTX and VTY of the action points are reset (VTX=0 and VTY=0). Next, in Step 22, the X value of the character parameter XY is set to "S", and the Y value thereof is set to "2" (XY="S2"). Then, in Step 23, the sum of the first total value VTX and the second total value VTY, that is, the aggregate total value VTA, is calculated. As same as the above-described first stage, the determination of shifting to the third stage from the second stage is carried out by comparing the aggregate total value VTA with the determination threshold value.

In Step 24 following Step 23, the aggregate total value VTA is judged whether it has reached a determination threshold value (60 points as an example), which is required for shifting to the third stage. When it has reached the determination threshold value, it progresses to Step 31 in FIG. 14, and the third stage is started. On the other hand, when the aggregate total value VTA has not reached the determination threshold value, the action point counting process shown in FIGS. 16 and 17 is carried out (Step 25). Thereby, the total values VTX and VTY of the action points are suitably updated according to the action point VTxyi corresponding to the time that the dog type robot 1 has taken reaction behavior (the reaction behavior time).

(Third Stage)

When the aggregate total value VTA has reached 60, the second stage shifts to the third stage (the human level). As shown in FIG. 11, the character parameters XY in the third stage are assigned to a two dimensional matrix-like domain (4×4), which the horizontal axis is the first total value VTX and the vertical axis is the second total value VTY. Therefore, there are sixteen kinds of characters of the dog type robot 1 set in the third stage.

Figure 14:
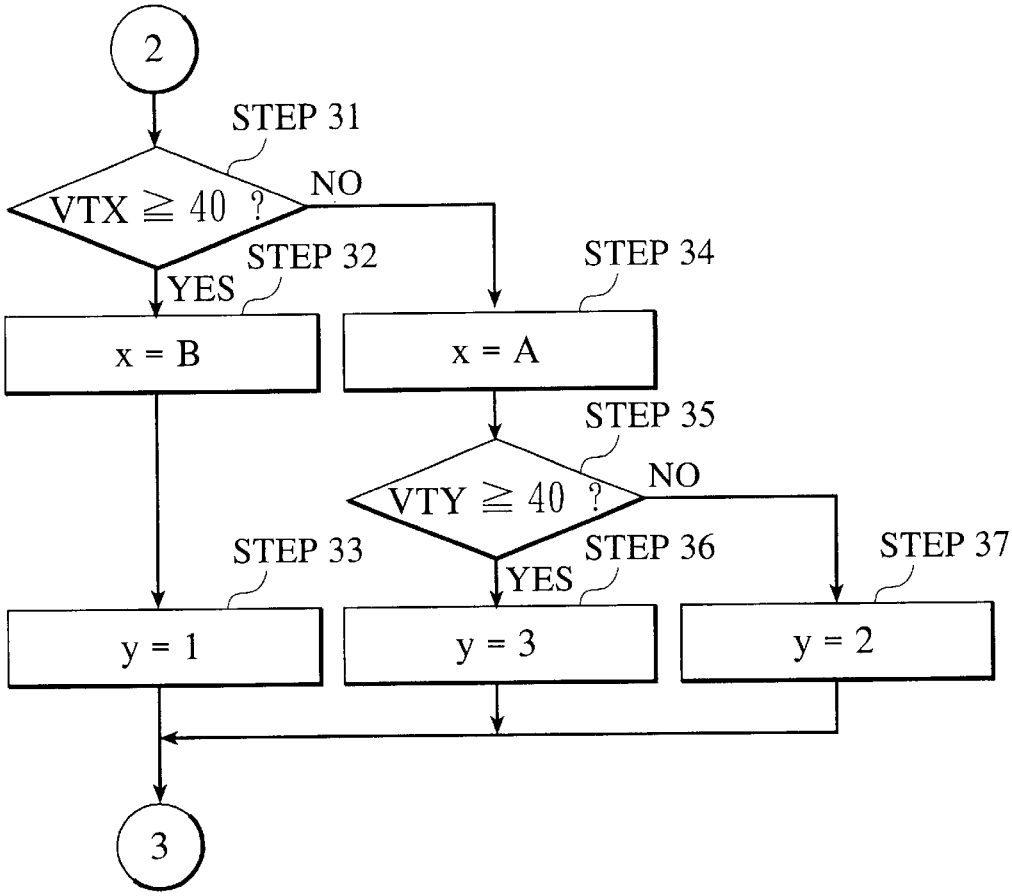
FIG. 14 is a flowchart showing a configuration procedure of an initial state in the third stage according to the embodiment of the present invention.

FIG. 14 is a flowchart showing a configuration procedure of the initial state in the third stage. As described above, the aggregate total value VTA, which is required to shift to the third stage, is 60. Therefore, referring to FIG. 11, the X value of the character parameter XY at the time of shifting is either A or B, and the Y value thereof becomes 1, 2, or 3.

At first, in Step 31, it is judged whether the first total value VTX is 40 or more. When the total value VTX is 40 or more, the X value of the character parameter XY is set to "B", and the Y value thereof is set to "1" (Steps 32 and 33), so that the character parameter XY is "B1". On the other hand, when the total value VTX is less than 40, the X value of the character parameter XY is set to "A", firstly (Step 34). Then, it progresses to Step 35, and it is judged whether the second total value VTY is 40 or more. When the total value VTY is 40 or more, the Y value of the character parameter XY is set to "3" (Step 36), so that the character parameter XY becomes "A3". On the contrary, when the total value VTY is less than 40, the Y value of the character parameter XY is set to "2" (Step 37), so that the character parameter XY becomes "A2". Therefore, the initial value of the character parameter XY, which is set right after shifting to the third stage, becomes "B1", "A3", or "A2".

Figure 15:
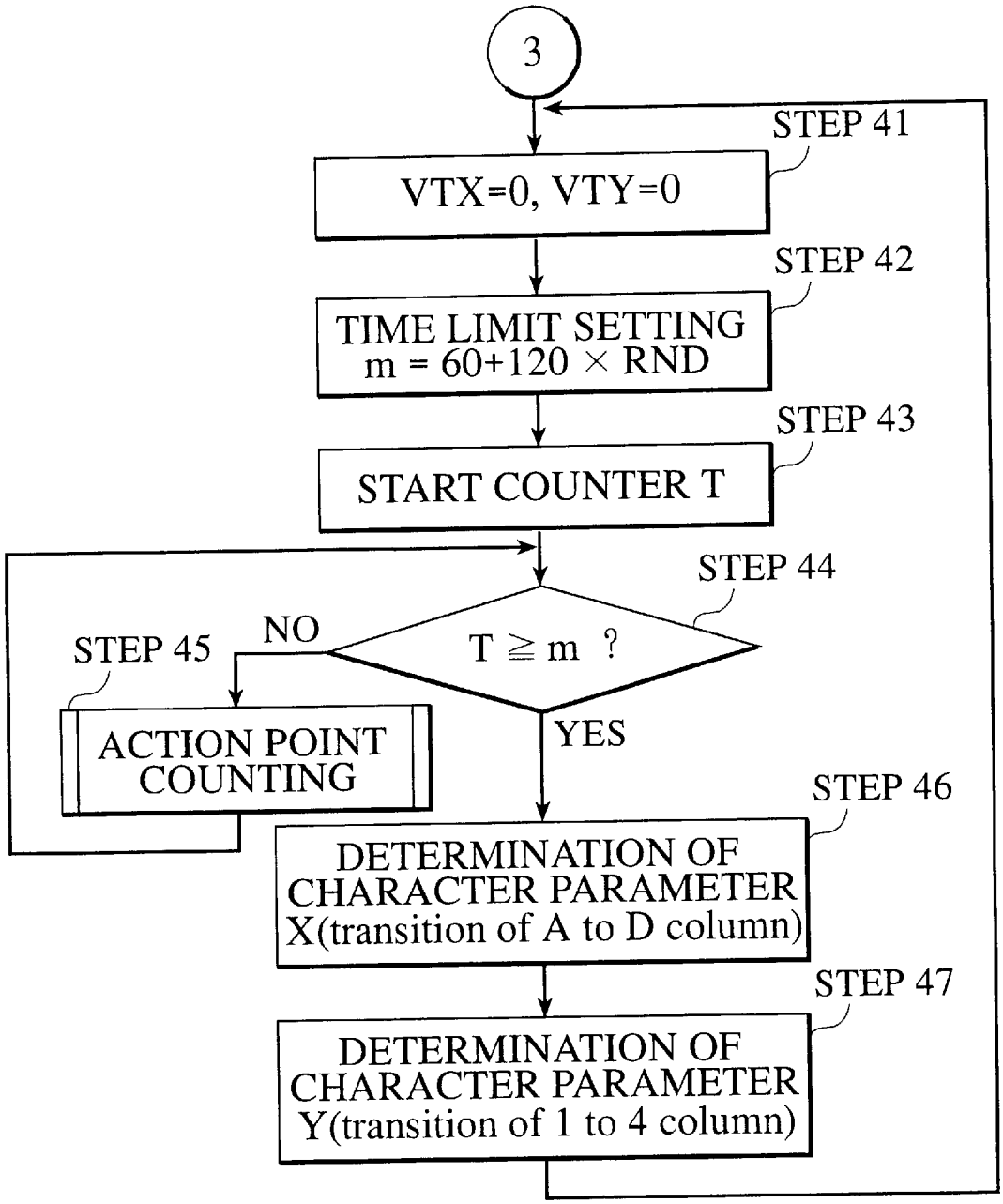
FIG. 15 is a flowchart showing a process procedure in the third stage according to the embodiment of the present invention.

When the initial value of the character parameter XY is set by following the procedure shown in FIG. 14, it progresses to Step 41 in FIG. 15. At first, in Step 41, the total values VTX and VTY of the action points are reset (VTX=0 and VTY=0). Next, in Step 42, by using a random number, an arbitrary time limit m (that is, the time that the counting process of the total values VTX and VTY is carried out) between 60 and 180 minutes, is set at random. The reason setting the time limit m at random is for not giving regularity to the transition of the character parameters XY (the change of characters of the dog type robot 1). Thereby, since it becomes difficult for a user to read the patterns related to the reaction behavior of the dog type robot 1, it can prevent the user from being bored. After the time limit m is set, counting by the timer 16 is started, and increment of a counter T is started (Step 43).

The "action point counting process" (cf. FIGS. 16 and 17) by Step 45 continues until the counter T reaches the time limit m. Therefore, the total values VTX and VTY of the action points are suitably updated according to the action point VTxyi corresponding to the time that the dog type robot 1 has taken reaction behavior (the output time).

On the other hand, when the counter T has reached the time limit m, the determination result of Step 44 is switched from negation to affirmation. Thereby, by following the following transition rule, the X value of the character parameter XY is updated based on the first total value VTX (Step 46).

[X value transition rule]

| The first total value | present X value → after updating X value | | | |
|---|---|---|---|---|
| VTX < 40 | A → A | B → A | C → B | D → C |
| 40 ≦ VTX < 80 | A → B | B → B | C → B | D → C |
| 80 ≦ VTX < 120 | A → B | B → C | C → C | D → C |
| 120 ≦ VTX | A → B | B → C | C → D | D → D |

Then, in the next Step 47, by following the following transition rule, the Y value of the character parameter XY is updated based on the second total value VTY (Step 47).

[Y value transition rule]

| The second total value | present Y value → after updating Y value | | | |
|---|---|---|---|---|
| VTY < 20 | 1 → 1 | 2 → 1 | 3 → 2 | 4 → 3 |
| 20 ≦ VTY < 40 | 1 → 2 | 2 → 2 | 3 → 2 | 4 → 3 |
| 40 ≦ VTY < 80 | 1 → 2 | 2 → 3 | 3 → 3 | 4 → 3 |
| 80 ≦ VTY | 1 → 2 | 2 → 3 | 3 → 4 | 4 → 4 |

As known from the matrix-like character state map shown in FIG. 11, when transitioning from the present state XYi to the state after updating XYi+1, it transitions to any one of a maximum of nine cells (including the present cell), which are adjacent to the present cell. For example, when it is the cell whose present value of a character parameter XY is "B2", the transition place becomes any one of the cells "A1" to "A3", "B1" to "B3", or "C1" to "C3", which are adjacent to the cell "B2".

When the process of Step 47 is finished, it returns to Step 41, and the above-described serial procedure is carried out repeatedly. Thereby, the update of the character parameter XY for every time limit m, which is set at random, is carried out. The character parameters XY assigned to each cell in FIG. 11, are arranged so that the character and behavior tendency among the adjacent cells may be mutually irrelevant. Therefore, in the third stage (the human stage), the dog type robot 1 that had taken a gentle behavior at present may suddenly become rebellious by the update of the character parameter XY. Therefore, a user can enjoy the whimsicality of the dog type robot 1.

Further, the update of the character parameter XY is carried out based on both the first total value VTX and the second total value VTY. Thus, it becomes difficult for a user to predict the character of the dog type robot 1, since the character of the dog type robot 1 is set based on a plurality of parameters. As a result, since a user cannot guess the character change patterns, the user never becomes bored.

Thus, in the embodiment of the present invention, the character of the dog type robot 1 is set by the character parameter XY, which affects the reaction behavior of the dog type robot 1. The character parameter XY is determined based on the total values VTX and VTY calculated by counting the generated action points caused by the reaction behavior (output) that the dog type robot 1 actually performed. These total values VTX and VTY are the parameters that are difficult for a user to grasp, compared with the number of times of stimulus (input) used in the earlier technology. Moreover, in order to make the grasp by a user much more difficult, the time (the time limit m) to count the total values VTX and VTY is set at random. Therefore, it is hard for a user to predict the appearance trend related to the reaction behavior of the dog type robot 1. As a result, since it is possible to entertain a user over a long period of time without making the user bored, an interactive toy, which has a high goods sales drive power, can be provided.

Especially, the character of the dog type robot 1 in the third stage (the human level) is suitably updated with reference to the matrix-like character state map which made both the first total value VTX and the second total value VTY the input parameters. Thus, if the character of the dog type robot 1 is changed by using a plurality of input parameters, the transition of change of the character will be rich in variation, compared with an update technique by a single input parameter. As a result, it becomes possible to further raise a sales drive power of goods as an interactive toy.

(Modified Embodiment 1)

In the above-described embodiment of the present invention, an interactive toy having a form of a dog type robot is explained. However, naturally, it can be applied to interactive toys of other forms. Further, the present invention can be widely applied to "imitated life objects" including a virtual pet, which is incarnated by software, or the like. An applied embodiment of a virtual pet is described below.

A virtual pet is displayed on a display of a computer system by carrying out a predetermined program. Then, means for giving stimulus to the virtual pet is prepared. For example, an icon (a lighting switch icon or a bait icon or the like) displayed on a screen is clicked, so that a light stimulus or bait can be given to the virtual pet. Further, a voice of a user may be given as a sound stimulus through a microphone connected to the computer system. Moreover, with operation of a mouse, it is possible to give a touch stimulus by moving a pointer to a predetermined portion of the virtual pet and clicking it.

When such a stimulus is inputted, the virtual pet on the screen takes reaction behavior corresponding to the contents of the stimulus. In that case, an action point, which is caused by the reaction behavior (output) of the virtual pet and has correlation with the reaction behavior, is generated. The computer system calculates the total value of the counted action points. Then, a reaction behavior pattern of the virtual pet is changed suitably by using a technique such as the above-described embodiment.

When incarnating such a virtual pet, the functional block structure in the computer system is the same as the structure shown in FIG. 2. Further, the growth process of the virtual pet is the same as the flowcharts shown in FIGS. 12 to 16.

(Modified Embodiment 2)

In the above-described embodiment of the present invention, a stimulus is classified into two categories, a contact stimulus (a touch stimulus) and a non-contact stimulus (a sound stimulus and a light stimulus). Then, the total value of the action points caused by the contact stimulus and the total value of the action points caused by the non-contact stimulus are calculated separately. However, the non-contact stimulus may be further classified into the sound stimulus and the light stimulus, and the total values caused by each stimulus may be calculated separately. Thereby, three total values corresponding to the touch stimulus, the sound stimulus, and the light stimulus may be calculated, and the character parameters XY in the third stage (the human stage) may be determined by making these three total values into input parameters. Thereby, the variation of transition of change related to the character of the imitated life object can be made much more complicated.

(Modified Embodiment 3)

In the above-described embodiment of the present invention, the action point is classified by the contents (the kinds) of the inputted stimulus. However, other classifying techniques may be used. For example, a technique of classifying an action point according to the kinds of an output action can be considered. Concretely, the output time of the speaker 4 is counted, and the action point corresponding to the counted time is calculated. Similarly, the output time of the actuators 3 is counted, and the action point corresponding to the counted time is calculated. Then, each total value of the action points is used as the first total value VTX and the second total value VTY.

Thus, according to the present invention, the total value related to the generated action point caused by the reaction behavior (output) to a stimulus, is calculated. Then, the reaction behavior of an imitated life object is changed according to the total value. Therefore, it becomes difficult to predict the appearance trend of the reaction behavior of the imitated life object. As a result, since it is possible to entertain a user over a long period of time without making the user bored, it becomes possible to attempt the raise of a goods sales drive power.

The entire disclosure of Japanese Patent Application No. 2000-201720 filed on Jul. 4, 2000 including specification, claims, drawings and summary are incorporated herein by reference in its entirety.

What is claimed is:

1. An interactive toy comprising:

a stimulus detecting member for detecting an inputted stimulus;

an actuating member for actuating the interactive toy; and a control member for controlling the actuating member in order to make the interactive toy take a reaction behavior to the stimulus detected by the stimulus detecting member;

wherein the control member sets a plurality of reaction behavior patterns to the stimulus, selects one of the plurality of the reaction behavior patterns according to an appearance probability prescribed beforehand, adds or subtracts a generated action point caused by the reaction behavior of the interactive toy based on the selected reaction behavior pattern and stores the added or subtracted action point, and changes the reaction behavior of the interactive toy according to a total value of the stored action points.

2. The interactive toy as claimed in claim 1, wherein the generated action point caused by the reaction behavior of the interactive toy is a number of points according to contents of the reaction behavior.

3. The interactive toy as claimed in claim 2, wherein the generated action point caused by the reaction behavior of the interactive toy is a number of points corresponding to a time of the reaction behavior.

4. The interactive toy as claimed in claim 1, wherein the control member counts the total value within a time limit set at random.

5. The interactive toy as claimed in claim 1, wherein the control member distributes the generated action point caused by the reaction behavior of the interactive toy at least to one of a first total value and a second total value, according to a predetermined rule, and thereafter, the control member counts the first total value and the second total value; and the control member determines the reaction behavior of the interactive toy based on the first total value and the second total value.

6. The interactive toy as claimed in claim 5, wherein the action point is distributed to one of the first total value and the second total value according to contents of an inputted stimulus.

7. The interactive toy as claimed in claim 6, wherein the control member distributes a generated action point caused by reaction behavior to a contact stimulus to the first total value, and the control member distributes a generated action point caused by reaction behavior to a non-contact stimulus to the second total value.

8. The interactive toy as claimed in claim 5, further comprising:

a character state map in which a plurality of character parameters that affect the reaction behavior of the interactive toy are set, the character parameters being written in the character state map by matching with the first total value and the second total value; and wherein the control member selects a character parameter based on the first total value and the second total value, with reference to the character state map, and the control member determines the reaction behavior of the interactive toy based on the selected character parameter.

9. The interactive toy as claimed in claim 1, wherein the control member sets a plurality of growth stages for making the interactive toy grow in stages according to contents of the reaction behavior of the interactive toy, and shifting to a next growth stage occurs when the total value of the action points exceed a predetermined value.

10. The interactive toy as claimed in claim 9, wherein the reaction behavior of the interactive toy develops with the shifting of the growth stages.

11. The interactive toy as claimed in claim 9, wherein a plurality of the reaction behavior patterns are set for each of the growth stages.

* * * * *